343-909

8/5/86 OR 4,604,629

United States Patent [19]

Hannan

[11] Patent Number: 4,604,629

[45] Date of Patent: Aug. 5, 1986

[54] AXIAL CONDUCTANCE ANGULAR FILTER

[75] Inventor: Peter W. Hannan, Smithtown, N.Y.

[73] Assignee: Hazeltine Corporation, Commack, N.Y.

[21] Appl. No.: 602,885

[22] Filed: Apr. 23, 1984

[51] Int. Cl.[4] ..... H01Q 15/02

[52] U.S. Cl. ..... 343/909

[58] Field of Search ..... 343/753, 754, 755, 909

[56] References Cited

U.S. PATENT DOCUMENTS 4,169,268 9/1979 Schell et al. ..... 343/909

4,344,077 8/1982 Chekroun et al. ..... 343/909

4,495,506 1/1985 Sasser et al. ..... 343/909

4,518,966 5/1985 Sadones ..... 343/909

*Primary Examiner*—Eli Lieberman

*Attorney, Agent, or Firm*—E. A. Onders; F. R. Agovino

[57] ABSTRACT

An array of axially oriented thin resistive elements having a certain value of conductance or resistance in the axial direction is supported in dielectric material. For a wave at normal incidence, the apparatus is essentially invisible. For a wave incident at oblique angles in the E plane, current is induced in the resistive elements and dissipative attenuation occurs. The attenuation does not rely on resonance so that the apparatus operates over a wide frequency band and does not require tight dimensional tolerances.

10 Claims, 10 Drawing Figures

$I \sim E_{ax} \sim \sin T$

DISSIPATED POWER $\sim I^2R \sim \sin^2 T$

AXIAL CONDUCTANCE ANGULAR FILTER

The Government has rights in this invention pursuant to Contract F19628-81-C-0067 awarded by the Department of the Air Force, Rome Air Development Center.

BACKGROUND OF THE INVENTION

1. Field of the Invention

The invention relates generally to angular filters and, in particular, to an array of axially oriented resistive elements supported by dielectric material.

2. Description of the Prior Art

An angular filter is a device which passes or rejects an electromagnetic wave depending on the angle of incidence of this wave relative to the filter surface. Typically, angular filters are designed to pass a wave at normal incidence (broadside) and to provide rejection that increases with angle of incidence away from broadside. Such a filter offers the potential for reducing sidelobes in the radiation patterns of directive antennas. Several types of angular filters, also called spatial filters, have been invesitgated including multilayered dielectric filters (R. J. Mailloux, "Synthesis of Spatial Filters with Chebyshev Characteristics", IEEE Trans. Antennas and Progagation, pp. 174–181; March 1976), perforated metal-sheet filters (E. L. Rope, G. Tricoles, "An Angle Filter Containing Three Periodically Perforated Metallic Layers", IEEE AP-S Int. Symp. Digest, pp. 818–820; 1979) and multilayered metal-grid filters (R. J. Mailloux, "Studies of Metallic Grid Spatial Filers", IEEE Int. Symp. Digest, p. 551, 1977; P. R. Franchi, R. J. Mailloux, "Theoretical and Experimental Study of Metal Grid Angular Filters for Sidelobe Suppersion", IEEE Trans. Antennas and Propagation, pp. 445–450, May 1983; P. W. Hannan and J. F. Pedersen, "Investigation of Metal-Grid Angular Filters", Proc. 1980 Antenna Applications Symposium, Allerton Park, Ill., September 1980; and J. F. Pedersen, P. W. Hannan, "A Metal-Grid 5×5 Foot Angular Filter", IEEE AP-S Symp. Digest, pp. 471–474, 1982). Metal-grid angular filters are practical and can offer improved performance (reduced wide-angle sidelobes) when added to an antenna. However, such filters have certain limitations. One limitation of metal-grid filters is the inherent relation between the angular characteristic and the frequency characteristic of the filter. Typically this results in a useful frequency bandwidth that is not very wide. Another limitation, inherent in the resonant nature of such filters, is the need to construct them with tight dimensional tolerances. Failure to hold sufficiently tight tolerances can result in variations of transmission phase across the filter aperture for incidence angles within the filter angular passband. Such phase variations can create unwanted sidelobes in the pattern of the antenna/filter combination. A third limitation of such filters is that they reject power by reflection rather than by absorption. This reflected power can return to the antenna that is associated with the filter, and then may reflect again to yield unwanted sidelobes within the angular passband of the filter.

SUMMARY OF THE INVENTION

It is an object of the this invention to provide an angular filter which operates over a wide frequency band and does not require tight demensional tolerances. It is another object of this invention to provide an angular filter that is inherently nearly invisible at broadside incidence, so that tight dimensional tolerances are not needed to obtain error-free transmission through the filter at broadside incidence; and which provides rejection by absorption rather than by reflection.

The axial conductance angular filter according to the invention passes a wave of electromagnetic energy at normal incidence thereto and attenuates a wave of electromagnetic energy at other than normal incidence thereto. The filter according to the invention comprises a plurality of parallel resistive elements supported by dielectric material.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
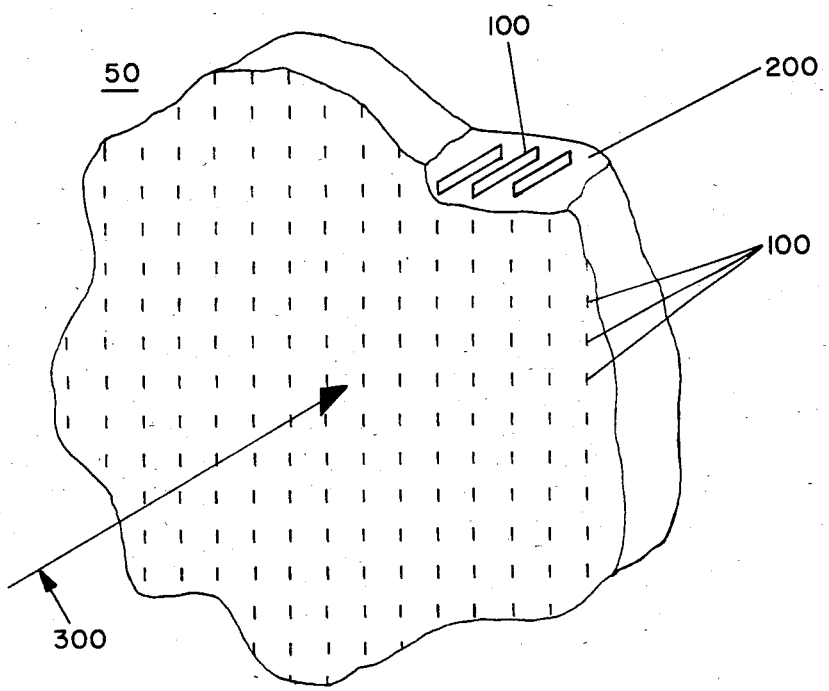
FIG. 1 is a partial view, in perspective, of an axial conductance angular filter according to the invention.

FIG. 1 describes an axial conductance angular filter according to the invention. Specifically, an array of axially oriented resistive elements 100 (such as rods or strips) having a certain value of conductance or resistance in the axial direction is embedded in a dielectric supporting material 200. These thin axial elements 100 are neither good reflectors nor good conductors, but rather, provide a certain amount of conductance or resistance in the axial direction. The amount will be described below in detail. A wave 300 at normal incidence (i.e. in the axial direction) does not induce current in the axial resistive elements, and the filter is essentially invisible to this wave. For oblique angles of incidence in the E plane, current is induced in the resistive elements 100 and dissipative attenuation occurs. The angular filter 50 operates over a wide frequency band and does not require tight dimensional tolerances because the dissipative attenuation does not rely on resonance.

Figure 2:
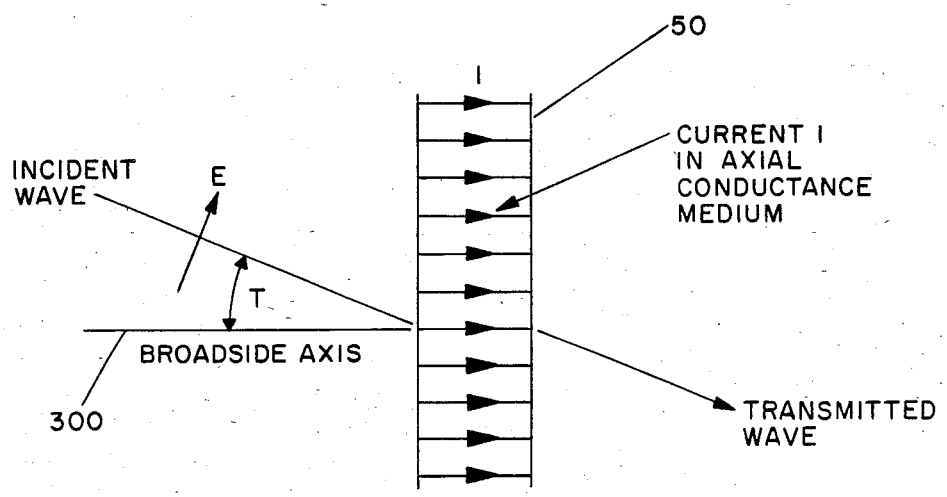
FIG. 2 illustrates an electromagnetic wave incident on an angular filter in the E plane of incidence.

As indicated in FIG. 2, an electromagnetic wave incident on filter 50 in the E plane of incidence has an axial component of electric field which is proportional to sin T, where T is the angle of incidence away from broadside 300. If we assume that this is also true within the filter medium, then the axial current I in the filter should also be proportional to sin $\theta$. Since this current flows through resistive elements, there is power dissipated within the filter. This dissipated power should be proportional to $I^2$ and hence proporational to $\sin^2 T$.

This heuristic analysis neglects to account for the effect of the axial-conductance medium on the incident wave, and it does not relate the dissipated power to the incident power. Nevertheless, the $\sin^2 T$ proportionality is a fairly good approximation for the dissipative loss of the axial-conductance angular filter 50.

Assuming that the $\sin^2 T$ proportionality represents the dissipative loss of an axial-conductance filter, we can expect that filter 50 should provide continuously increasing rejection with incidence angle in the E plane. This desirable result does not always occur with other types of angular filters. For example, the multilayer dielectric filter is subject to Brewster-angle effects in the E plane of incidence, and the crossed metal-grid filter may provide little or no rejection near grazing incidence in the E plane.

Another feature that can be anticipated for axial-conductance filter 50 is that it should be inherently invisible at broadside incidence. This is a result of its thin axially-oriented elements which have essentially no effect when the electric field is prependicular to them. Such a filter, when placed in the aperture of a narrow-beam antenna, should have only a small risk of adversely effecting the main beam or raising the nearby sidelobes.

A corollary of this inherent broadside invisibility is that axial-conductance filter 50 does not have critical tolerances on dimensions or materials. Variations of filter thickness or resistance values do not affect the amplitude or phase of the main-beam power passing through the filter near broadside incidence, so no new sidelobes are created. Only the wide-angle rejection value would be affected, which is not a critical factor.

Still another feature that can be anticipated for axial conductance filter 50 is that its rejection of incident power will occur primarily by means of absorption. Reflection from the filter for most angles of incidence will tend to be fairly small. This reduces the chance that rejected power will return to the antenna and then be re-reflected to create new sidelobes.

Finally, it can be anticipated that axial-conductance filter 50 would provide all of the above features over a wide frequency band. Since its operation does not depend on a resonance or a grating-lobe phenomenon, its is not strongly affected by a change of frequency. There is a certain relation between wide-angle rejection and frequency, but this can still permit a wide useful frequency band of operation.

The features mentioned in the previous paragraphs involve some limitations that do not occur with other types of angular filters. One limitation of axial-conductance filter 50 is that it provides rejection versus angle only in the E plane of incidence. Another limitation is that a sharp increase of rejection with incidence angle (i.e., a sharp cutoff) is not obtainable, unless some resonant or frequency-sensitive mechanism is incorporated into the filter medium. Even with these limitations, the positive features of axial-conductance filter 50 make it worthy of consideration for use either alone or in combination with another filter.

Each resistive element 100 should have a substantially low conductivity. In particular, the range of the conductivity of the resistive elements can be defined as follows. If the dielectric 200 is assumed to have an effective permittivity approximately equal to that of free space and the resistive elements 100 embedded therein are assumed to form a filter medium which is homogeneous with a certian axial conductance ($S_{ax}$), the attenuation constant (A) in the medium (in napiers per meter) can be derived as a function of the E-plane incidence angle (T):

$$A = -\frac{2\pi}{\lambda} Im\left[1 - \frac{\sin^2 T}{1 - jS_{ax}/WE_o}\right]^{\frac{1}{2}}$$

Where W is the frequency of the incident electromagnetic energy in radians per second and $E_o$ is the permittivity (or electric constant) of free space and $\lambda$ is the wavelength of the incident wave in meters. The parameters $S_{ax}/WE_o$ is the axial loss tangent (D) of the medium.

Figure 3:
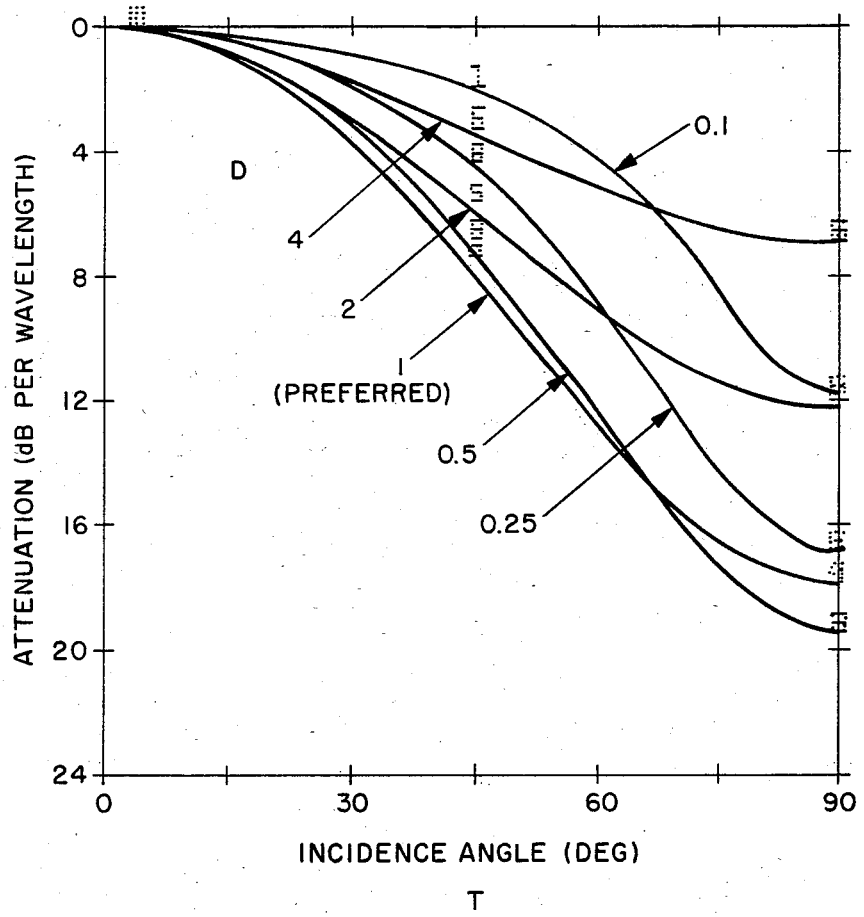
FIG. 3 is a graph illustrating the computed attenuation versus angle of incidence (in degrees) for a homogeneous filter medium according to the invention.

FIG. 3 is a graph illustrating computed curves of attenuation in decibels per wavelength of filter thickness versus T for various values of the axial loss tangent (D). It can be seen that a value for D near unity is preferred and that the actual value of D is non-critical and may be in the range of 0.5 to 2.0 while yielding nearly optimum performance.

A comparison of the several curves in FIG. 3 at small incidence angles confirms that $D=1$ gives the greatest attenuation at small angles. Also, the $D=1$ case gives almost, but not quite, the greatest attenuation near 90° incidence.

The curves of FIG. 3 give essentially the angular rejection characteristic of a filter using an axial-conductance medium. For example, with a medium having $D=1$, a rejection of almost 8 dB would be obtained for a wavelength-thick filter at 45° incidence. For a filter two wavelengths thick, almost 16 dB would be obtained at 45°.

At 90°, the attenuation for the $D=1$ case is about twice the value at 45°. In addition, there would be a substantial reflection loss near 90°. There is no indication in any of the curves of FIG. 3 that the filter rejection might decrease with increasing angle (as it can with some other types of angular filter).

Near 0° incidence, the filter attenuation characteristic is inherently square-law with angle. For a filter two wavelengths thick, the attenuation of the homogeneous axial-conductive medium would be less than 0.1 dB over a ±3° range of incidence angles centered on broadside. Thus a pencil-beam antenna having a beamwidth of 3° or less should have virtually no change of peak gain when operated with such a filter over its aperture.

Figure 10:
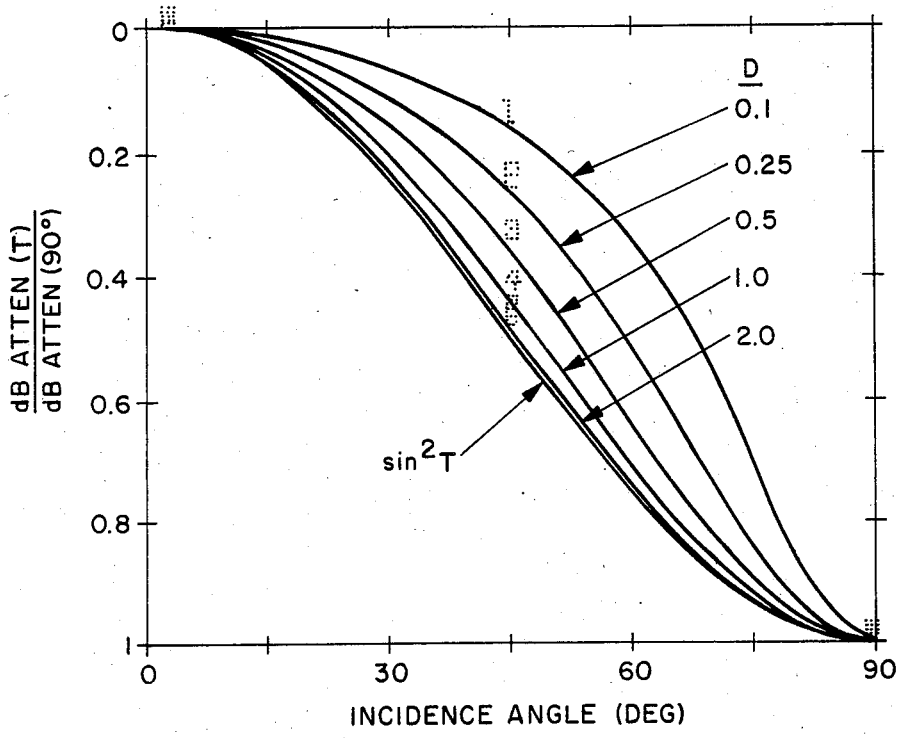
FIG. 10 is a graph illustrating the normalized attenuation versus incidence angle for various values of the axial loss tangent (D).

The shape of the curves in FIG. 3 is of some interest. To compare the shapes for different values of D, the attenuation of each curve can be normalized to its value at 90° incidence. FIG. 10 shows the resulting set of curves. Also shown is a $\sin^2 T$ curve. It is evident that for values of D equal to unity or more, the $\sin^2 T$ curve gives a good approximation to the actual shape of the A versus T curve. The approximation becomes poor for values of D much less than unity.

Another question is: how does the rejection at some angle vary over a wide frequency band? The answer to this question is contained in the curves of FIG. 3. It is evident that the basic factor is attenuation per wavelength of the medium. Thus, for a filter having a specified thickness (in inches), the principal term is a linear increase of attenuation with frequency.

A secondary term also exists because D is inversely proportional to frequency. However, if D is set to unity at midband, the variation of D that would occur over a frequency band as much as two octaves wide would still have only a relatively small effect on attenuation. This is another case in which the non-critical nature of D is helpful.

The actual inhomogeneous medium illustrated in FIG. 1 is more difficult to analyze and its performance is more complex. However, when the resistive elements 100 are thin and are closely spaced relative to the wave length of the incident electromagnetic energy, the performance approximates that of the homogeneous medium as given in FIG. 3. Dielectric material having an effective permittivity substantially greater than that of free space also modifies the performance.

In order to understand the relationship between elements 100 and the axial loss tangent (D), it is helpful to define a quantity $R_\lambda$ as the resistance (in ohms) across a cube having wavelength sides. The quantity $R_\lambda$ is equal to the axial resistivity divided by wavelength, and hence equals $1/S_{ax}\lambda$. Defining the axial loss tangent (D) as equal to $S_{ax}/WE_o$, the relation between $R_\lambda$ and D is then obtained:

$$R_\lambda = \frac{60 \text{ ohms}}{D} \tag{1}$$

If a value of unity for D is wanted, then the medium should provide a resistance of 60 ohms in the axial direction between opposite faces of a wavelength cube.

Figure 9:
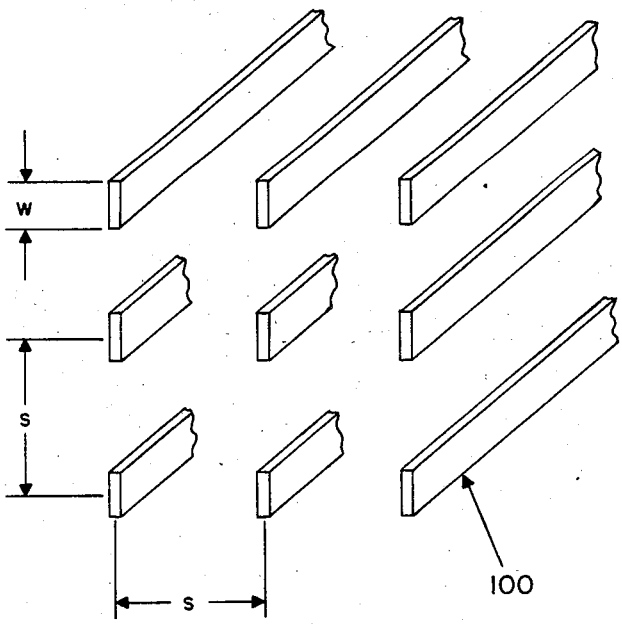
FIG. 9 illustrates in partial perspective view the strip-type medium which may be imbedded in a dielectric in accordance with the invention.

The resistance elements can have any convenient cross-sectional shape. In a preferred embodiment thin strips are selected because such strips can be produced by printed-circuit techniques. FIG. 9 is a partial perspective drawing showing an array of resistance strips comprising the inhomogeneous axial-conductance medium. The array lattice is square with spacing s, and the width of each strip is w.

It is assumed that the strips are very thin, and that their resistance behavior can be defined in terms of the surface resistance $R_s$ (in ohms per square) of the strip material. The following relation can then be derived.

$$R_\lambda = (s/\lambda)^2 \frac{\lambda}{w} R_s \tag{2}$$

Combining (1) and (2) yields a formula for $R_s$ in terms of D and the array/strip dimensions:

$$R_s = \frac{60 \text{ ohms}}{D} \frac{\lambda}{s} \frac{w}{s} \tag{3}$$

As an example, suppose that $s/\lambda=0.2$, and $w/s=0.2$, and a value of unity for D is wanted. Equation (3) then yields 60 ohms per square as the surface resistance needed for the strip material.

Figure 7:
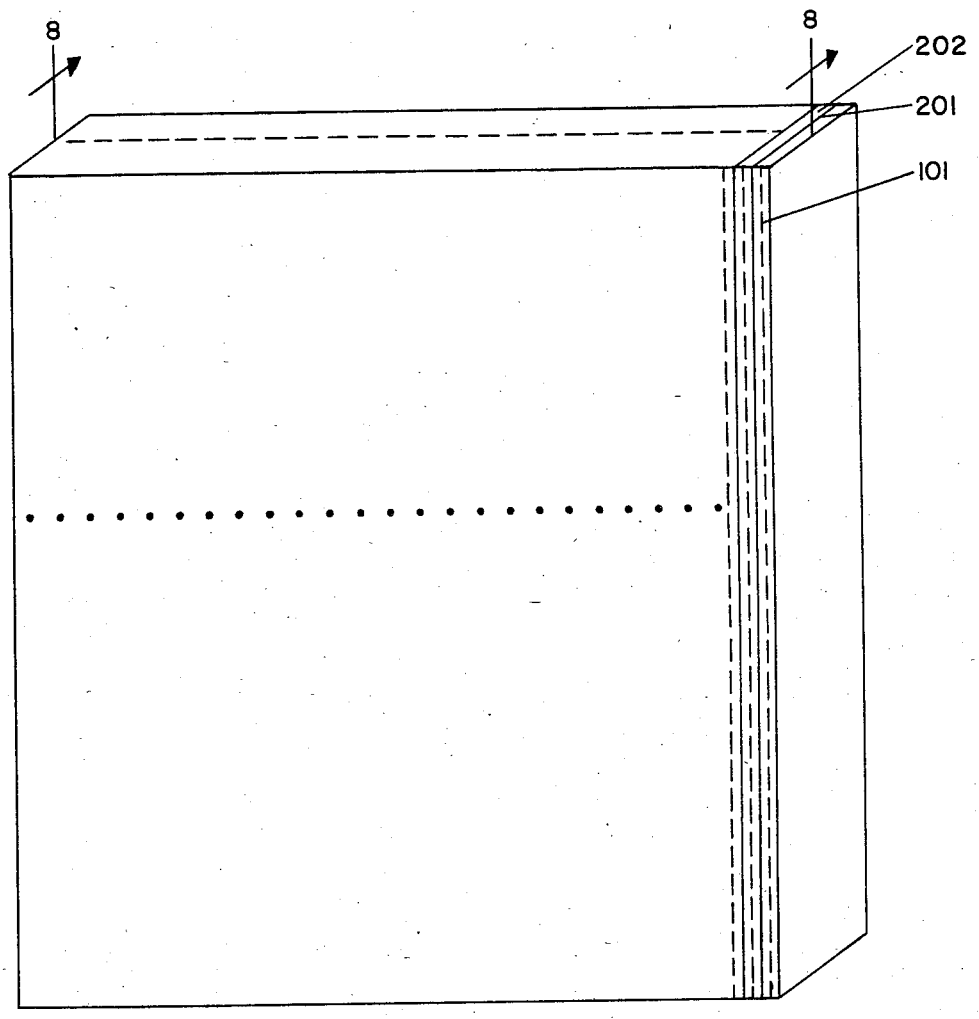
FIG. 7 is a perspective view of a preferred embodiment of a filter medium according to the invention.
Figure 8:
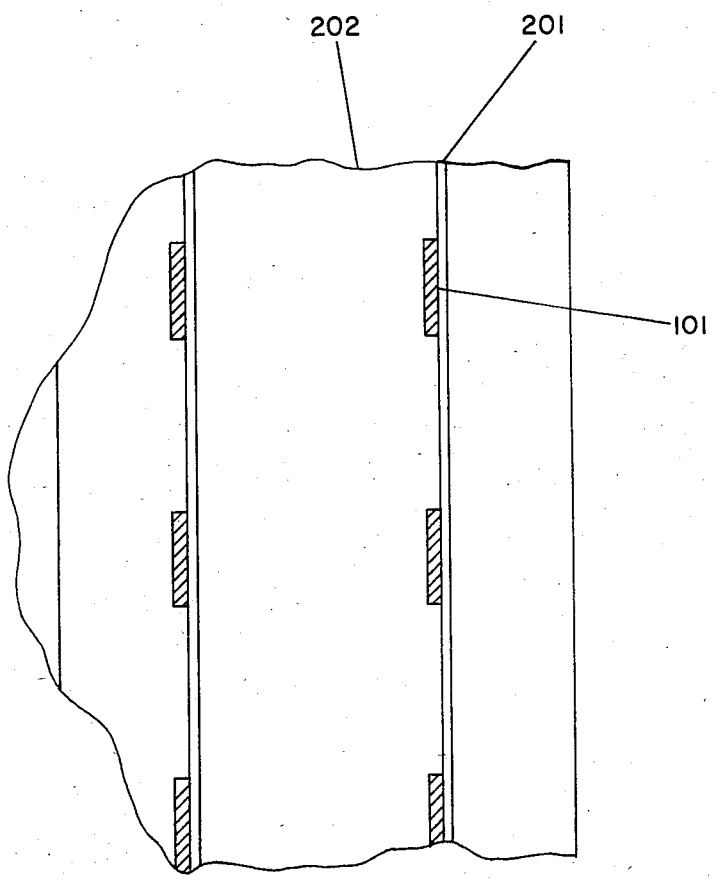
FIG. 8 is a cross sectional veiw of the medium of FIG. 7 taken along lines a—a.

A filter 5 feet by 5 feet in aperture size and 5 inches in thickness was developed for operation at 10 GHz. Resistive elements 100 of the developed filter were screen printed on thin dielectric sheets which were stacked alternately with foam spacers as shown in FIGS. 7 and 8. In particular, thin dielectric sheets 201 were screen printed so that resistive elements 101 were located on one surface thereof. Stacked between successive sheets 201 were dielectric sheets of foam spacers 202. This assembly was enclosed within a protective fiberglass shell and contained over 70,000 printed resistive elements 101.

Figure 4:
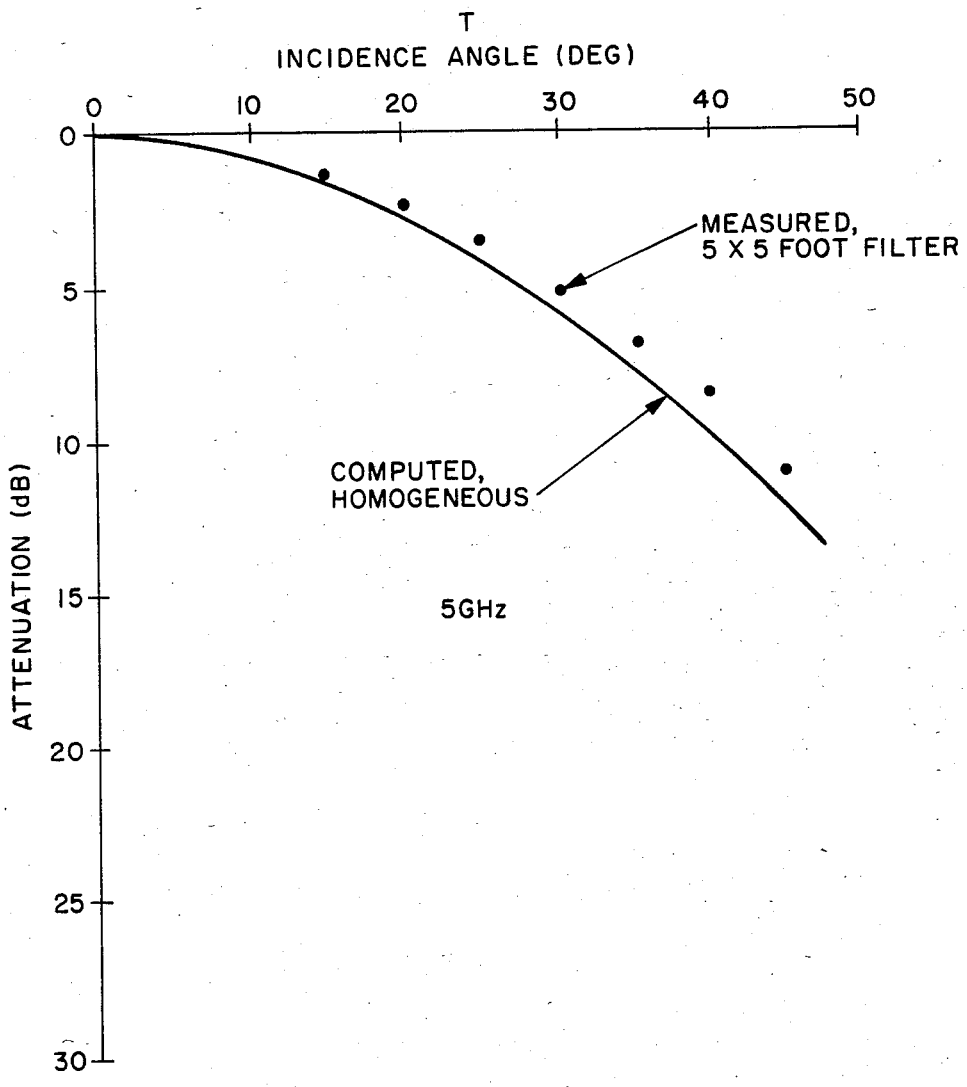
FIG. 4 is a graph comparing the measured and computed attenuation versus angle of incidence at 5 GHz for a 5×5 foot angular filter medium according to the invention.
Figure 5:
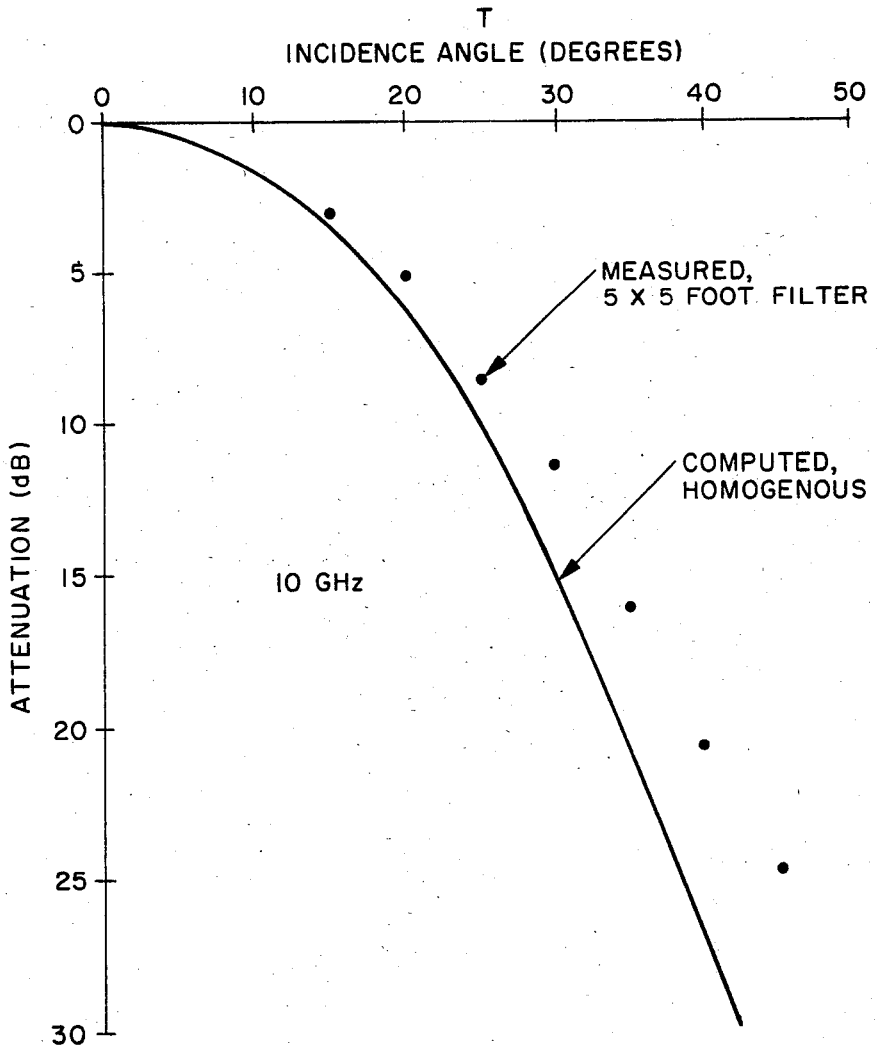
FIG. 5 is a graph comparing the measured and computed attenuation versus angle of incidence at 10 GHz for a 5×5 foot filter medium according to the invention.
Figure 6:
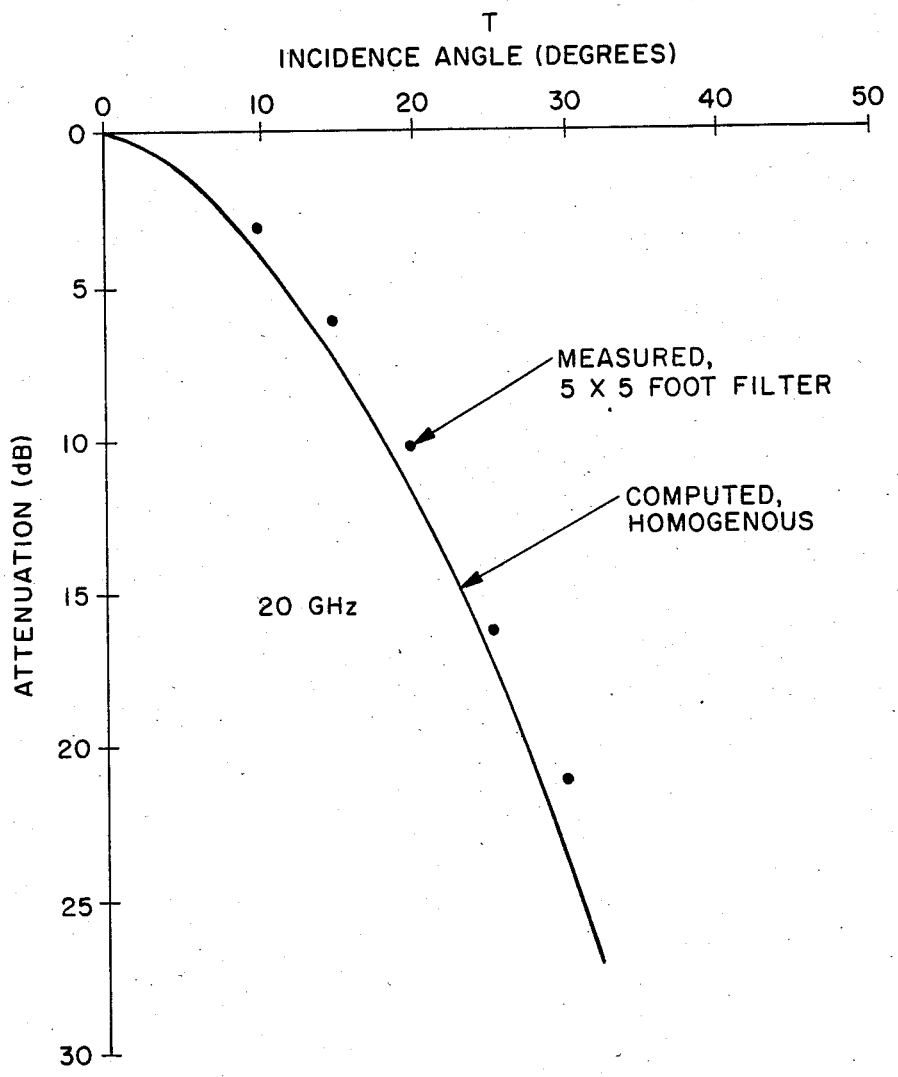
FIG. 6 is a graph comparing the measured and computed attenuation versus angle of incidence at 20 GHz of a 5×5 foot filter medium according to the invention.

The attenuation of the constructed filter was measured versus E-plane incidence angles at 5, 10 and 20 GHz. FIGS. 4, 5 and 6 show the measured attenuation points together with curves computed from the homogeneous medium analysis. Reasonable similarity between the two is evident. Additional measurements of filter samples in simulator wave-guide have yielded results similar to the computed values out to angles close to grazing incidence, where the panel measurements are difficult to obtain with accuracy. Thus, the axial conductance angular filter according to the invention has a yielded satisfactory and useful angular rejection characteristic over a two-octave bandwidth.

The angular filter according to the invention has been generally described as an array of parallel resistive elements 100 supported in dielectric material 200 being parallel to the normal of the sheet. The invention contemplates that more than one array of parallel resistive elements may be embedded in the dielectric and that the orientation of the resistive elements does not necessarily have to coincide with the direction perpendicular to the face of the dielectric.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An angular filter which passes a wave of electromagnetic energy at one angle of incidence to the apparatus and which attenuates waves of electro-magnetic energy at other angles of incidence, said apparatus comprising:

a. an array of a plurality of parallel, resistive elements, each of said elements having an elongated dimension, and having an axis along the elongated dimension; and b. means for supporting said elements whereby waves of electromagnetic energy impinging on said filter in a direction substantially parallel to the axis along the elongated dimension of said resistive elements passes through said filter and a wave of electromagnetic energy impinging on said filter at an angle with respect to the axis is substantially attenuated.

2. The angular filter of claim 1 wherein said apparatus has an axial loss tangent for a given frequency of electromagnetic energy in the approximate range of at least 0.5 and less than 2.0, wherein said axial loss tangent is defined by the axial conductance of the apparatus divided by the given frequency in radians per second and divided by the permittivity of free space.

3. The angular filter of claim 1 wherein said supporting means comprises dielectric material.

4. The angular filter of claim 3 wherein said array has a square lattice.

5. The angular filter of claim 3 wherein said axial loss tangent is approximately equal to unity.

6. The angular filter of claim 5 comprising screen printed elements on planar dielectric sheets which are stacked, the plane of the sheets being parallel to the axis.

7. The angular filter of claim 6 wherein said dielectric sheets have spaces therebetween.

8. The angular filter of claim 6 wherein said dielectric sheets have spacers of dielectric foam material therebetween.

9. The angular filter of claim 1 comprising screen printed elements on dielectric sheets which are stacked.

10. The angular filter of claim 5 comprising screen printed elements on dielectric sheets which are stacked.

* * * * *